US007168109B1

(12) United States Patent
Reid

(10) Patent No.: US 7,168,109 B1
(45) Date of Patent: Jan. 30, 2007

(54) SELF-PRIMING SIPHON TUBE FOR USE WITH A TOILET TANK AND BOWL FOR MAINTAINING A STEADY TRICKLE FLOW OF WATER THROUGH A SUPPLYING AND UNHEATED SERVICE LINE ASSOCIATED WITH THE TANK AND BOWL AND METHOD FOR INSTALLING THE SAME

(76) Inventor: Kennith L. Reid, 4391 N. Skookum Rd., Luther, MI (US) 49656

( * ) Notice: Subject to any disclaimer, the term of this patent is extended or adjusted under 35 U.S.C. 154(b) by 0 days.

(21) Appl. No.: 11/449,906

(22) Filed: Jun. 8, 2006

(51) Int. Cl.
*B47K 17/00* (2006.01)

(52) U.S. Cl. ..... 4/661

(58) Field of Classification Search ..... 4/661, 4/225.1, 227.7, 368, 372, 377; 137/132, 137/142, 152
See application file for complete search history.

(56) References Cited

U.S. PATENT DOCUMENTS 1,604,759 A * 10/1926 Richards ..... 4/370
3,105,245 A * 10/1963 Finkbiner ..... 4/225.1
5,381,568 A * 1/1995 Warkentin ..... 4/661

* cited by examiner

*Primary Examiner*—Huyen D. Le
(74) *Attorney, Agent, or Firm*—Douglas S. Bishop

(57) ABSTRACT

A self-priming siphon tube for maintaining a trickle flow of fluid through a toilet tank reservoir and a toilet bowl. A water supply line is in fluid communication with the tank by virtue of a ball cock valve, the tank reservoir fluidly interconnects with the bowl by an overflow tube. The siphon tube includes an elongated and interiorly hollowed body having first, second and third fluidly interconnecting and parallel extending lengths. An interconnecting end associated with the second and third extending lengths is inserted into the overflow tube and an end of the water supply line connected to an end of the third conduit, causing a trickle flow of fluid to be drawn from the tank reservoir, by vacuum pressure, into the first length, and out into the bowl, the ball cock valve occasionally activating to draw fluid from the supply line into the tank reservoir.

12 Claims, 4 Drawing Sheets

SELF-PRIMING SIPHON TUBE FOR USE WITH A TOILET TANK AND BOWL FOR MAINTAINING A STEADY TRICKLE FLOW OF WATER THROUGH A SUPPLYING AND UNHEATED SERVICE LINE ASSOCIATED WITH THE TANK AND BOWL AND METHOD FOR INSTALLING THE SAME

BACKGROUND OF THE INVENTION

1. Field of the Invention

The present invention relates generally to freeze prevention techniques for preventing the freezing of water lines and water reservoirs, and such as in particular during wintertime conditions. More particularly, the present invention teaches a one-piece and preformed siphon unit, designed to removably fit within an overflow tube associated with a toilet tank, and which provides for a steady trickle flow of water from the tank, through the tube and into the toilet bowl. The purpose of the invention is to maintain a steady flow of fluid through an exterior and unheated water service line, by virtue of the ball cock valve located in the base of the toilet tank, and in order to prevent freezing of the water supply line.

2. Description of the Prior Art

The prior art is well documented with examples of devices utilized to assist in preventing freezing of pipes and such as in particular cold water supply lines. One known example of such a device is the provision of heat tape, such including an electrical resistor, running the length of the tape, and a plug for engaging within an electrical socket. Shortcomings associated with heat tape include the incidence of the resistor element associated with the tape burning out, or the inadvertent unplugging of the connector from the wall outlet.

Additional examples from the prior art include U.S. Pat. No. 5,640,991, issued to King, and which teaches a siphon freeze drain for an underground water sprinkling system including a line operating under water pressure. A drain valve is in the form of a "U" shaped tube, one end of which is passed through a hole in the top of the line, the other end of which is outside the line at a lower level than the first end. A clamp and seal holds the tube in the line against the force of the water in the line and prevents leaking around the tube. A check valve is in the end of the tube outside the line, the check valve selectively opened and closed to control flow through the tube and for establishing a siphon for draining the line.

Mellard, U.S. Pat. No. 4,313,452, teaches a self-actuating variable rate water pipe bleeder including a small holding tank and a sample tube, both of which are filled with water and exposed to the ambient atmospheric pressure. The water in the sample tube freezes first when the ambient temperature is at freezing, and which in turn causes a piston and push rod arrangement in the sample tube to move against a small cover plate located in the holding tank, moving it away from the drain connection. When the cover plate is so moved, water from the water supply pipe will flow at a relatively slow but steady rate through the drain connection to the environment, maintaining a flow of water through the supply pipe and thus preventing the water in the water supply pipe upstream of the pipe from freezing.

An exterior thaw tube is attached to the drain connection in the holding tank and, when the ambient temperature increases to a few degrees above freezing, the ice in the thaw tube will thaw, resulting in a spray of water from the end of the thaw tube and which is directed into an interior thaw tube which is inside the sample tube, thawing the ice in the sample tube. The thawing of the ice in the sample tube results in the piston and the push rod retracting and the cover plate moving back into place, closing off the drain opening.

Finally, U.S. Pat. No. 4,481,966, issued to Anderson, teaches a waterline freeze protection system consisting of first and second branch pipes extending from a water service pipe, a water holding tank, and a metering orifice located between the first branch pipe and the holding tank. A pump and check valve are provided between the holding tank and the second branch pipe, the check valve permitting flow of water only in the direction from the pump to the second branch pipe, a float and switch secured to the holding tank activates the pump at an upper water level and deactivates the pump at a lower water level. An overflow pipe extending from the holding tank passes water from the holding tank into a drain when the pump is non-operational.

SUMMARY OF THE PRESENT INVENTION

The present invention is a one-piece and preformed siphon unit, designed to removably fit within an overflow tube associated with a toilet tank, and which provides for a steady trickle flow of water from the tank, through the tube and into the toilet bowl. As described previously, the purpose of the invention is to maintain a steady flow of fluid through an exterior and unheated water service line, by virtue of the ball cock valve located in the base of the toilet tank, in order to prevent freezing of the water supply line. A secondary advantage provided by the present invention is in maintaining an agitated and trickle flow within the toilet tank and bowl in order to prevent, in extreme cases, freezing of the same during periods of non-heating of the interior structure within which it is located.

The siphon tube is typically constructed of a durable plasticized or other suitable material and includes an elongated and interiorly hollowed body having first and second fluidly interconnecting and parallel extending lengths. In order to achieve the desired vacuum effect when submerged in the tank, the first length is a specified length shorter than the second length, and it is also desirable that either or both of the first and second ends are angled in order to prevent the interruption of the vacuum flow, such as which occurs during seating against the bottom surface of the reservoir tank.

An upper interconnecting end established between the fluid lengths further includes a plurality of winding coils. In particular, an upper end of the coils interconnects with the shorter first length of the siphon tube, a lower spiraling end communicates with longer second length. Upon prefilling the siphon tube with a volume of fluid, the first shorter end is temporarily sealed, such as by the installer temporarily holding his finger over the first end, and while the extending second length is inserted into the overflow tube and the first end submerged into the tank reservoir. At that point, a trickle flow of fluid is drawn from the tank reservoir, by vacuum pressure, into the first length, across the winding coils, and out the second length into the bowl, the ball cock valve occasionally activating to draw fluid from the supply line into the tank reservoir.

A further preferred embodiment includes a first extending length and a second fluidly interconnecting and parallel extending length separated from the first length by an upper "U" shaped interconnecting portion. Additional features of the self-priming siphon tube include the second extending length terminating in a "Y" fitting, such as which further includes a downwardly extending open end. A third upwardly extending and substantially parallel length extends from the second length and terminates in a coupling which engages an extending end of the overflow line.

A method for installing a siphon tube as substantially described above is also disclosed and includes the basic steps of inverting the siphon tube so that first and second length ends are arrayed in a generally upwardly extending direction, prefilling the siphon tube with a volume of fluid and temporarily sealing the first length end. Additional steps include inserting the second extending length into the overflow tube vacuum drawing a trickle flow of fluid the tank reservoir, into the first length, across the winding coils, and out the second length into the bowl, the ball cock valve occasionally activating to draw fluid from the supply line into the tank reservoir.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
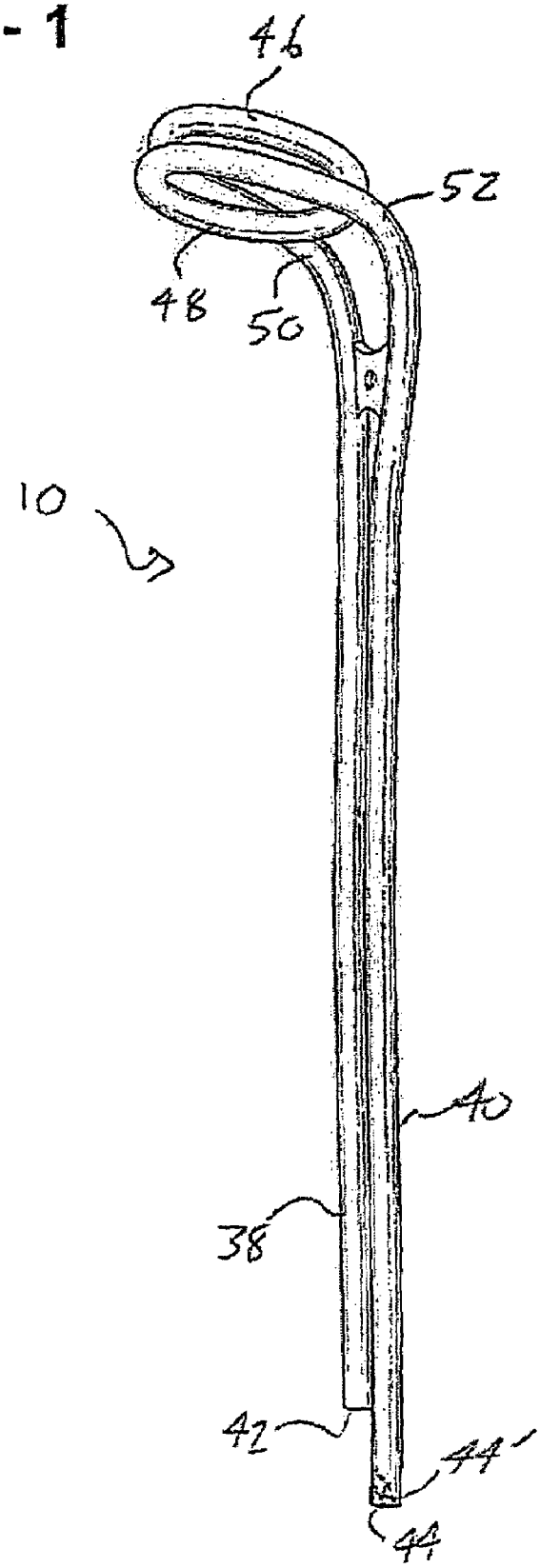
FIG. 1 is a perspective view of the siphon tube according to the present invention.

Referring now to FIGS. 1–5, a siphon tube is illustrated at 10 according to one preferred embodiment of the present invention. As described previously, the purpose of the siphon tube 10 is to maintain a steady flow of fluid through an exterior and unheated water supply/service line 12 (see FIG. 3) in order to prevent freezing of standing water located within an unheated/cold water supply line. A secondary advantage provided by the present invention is in maintaining an agitated and trickle flow within a toilet tank reservoir and bowl in order to prevent, in extreme cases, freezing of the same during periods of non-heating of the interior structure within which it is located.

Prior to discussing the particulars of the siphon tube 10 according to the present invention, a brief description of the conventional operating components of the toilet is provided and includes the provision of a ball cock assembly, see inlet cylinder 14, ball cock 16, ball cock stem 18, and inlet cylinder discharge line 20 all located within a toilet tank interior, further generally illustrated at 22 as a fluid reservoir holding body. Additional features associated with the conventional toilet include an overflow tube 24 vertically extending within the tank reservoir 22, an overflow line 26 extending from the fluid inlet cylinder 14 to the overflow tube 24. The overflow tube 24 further communicates with a sink discharge, typically leading to a toilet bowl 28 (see again FIG. 3).

Yet additional features of the existing toilet include an exteriorly actuated handle 30, attached stem 32 and valve plug 34, interconnected to the stem 32 via a chain 36. The conventional handle and plug assembly functions, in combination with the ball cock assembly, to drain and refill the tank reservoir in normal operation.

Referring again to FIGS. 1–5, the siphon tube 10 is typically constructed of a durable and plastic material which includes an elongated and interiorly hollowed body having a first extending length 38 and a second fluidly interconnecting and parallel extending length 40. In order to achieve the desired vacuum effect when submerged in the tank reservoir, the first length 38 is a specified length shorter than the second length 40, see end 42 for length 38 and associated end 44 for length 40. It is also desirable that either or both of the first and second associated length ends, such as is shown in phantom in FIG. 1 at 44' for second length 40, is angled in order to prevent the interruption of vacuum flow, resulting from seating/sealing of the associated length end and against such as a bottom surface of the tank reservoir.

As is illustrated throughout the figures, an upper interconnecting end established between the fluid lengths further includes at least a pair of winding coils 46 and 48. In the preferred embodiment, the coils 46 and 48 extending in a substantially perpendicular direction relative to the parallel running lengths 38 and 40. An upper end 50 of the coils (illustrated as an entrance point for first upper coil 46) interconnects with the shorter first length 38 of the siphon tube. A lower spiraling end 52 (of second downward coil 48) communicates with an entrance point of the longer second length 40.

Figure 3:
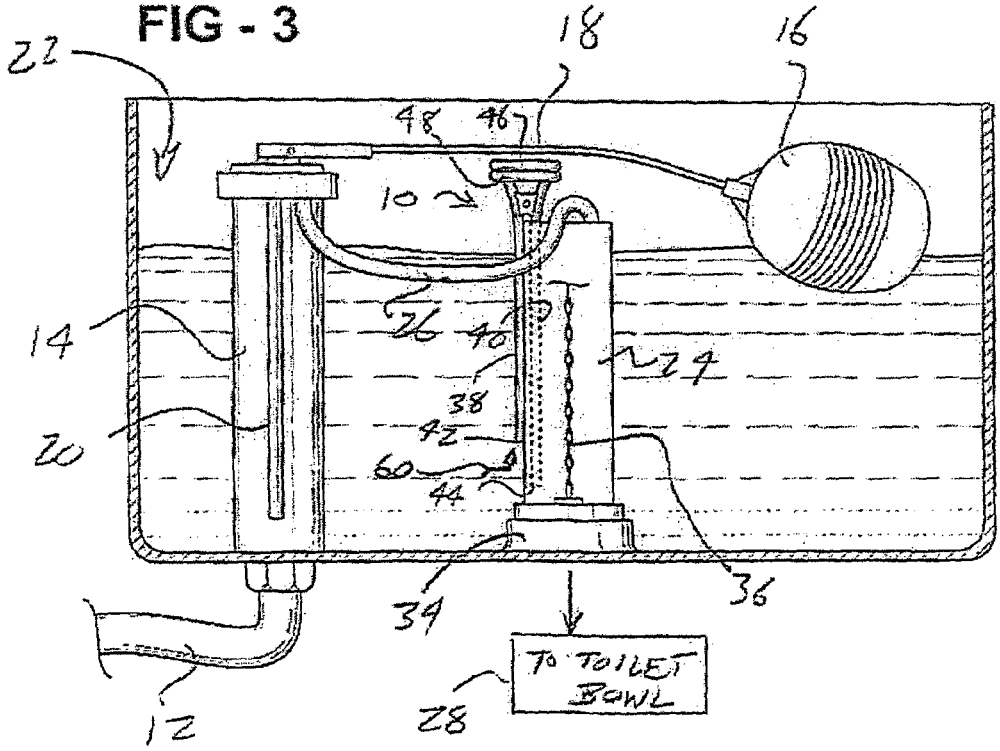
FIG. 3 is a cutaway environmental view, similar to that illustrated in FIG. 2, and further showing the siphon tube in installed fashion in the toilet tank overflow tube and which fluidly interconnects the water inlet feed, toilet tank reservoir and toilet bowl.
Figure 4:
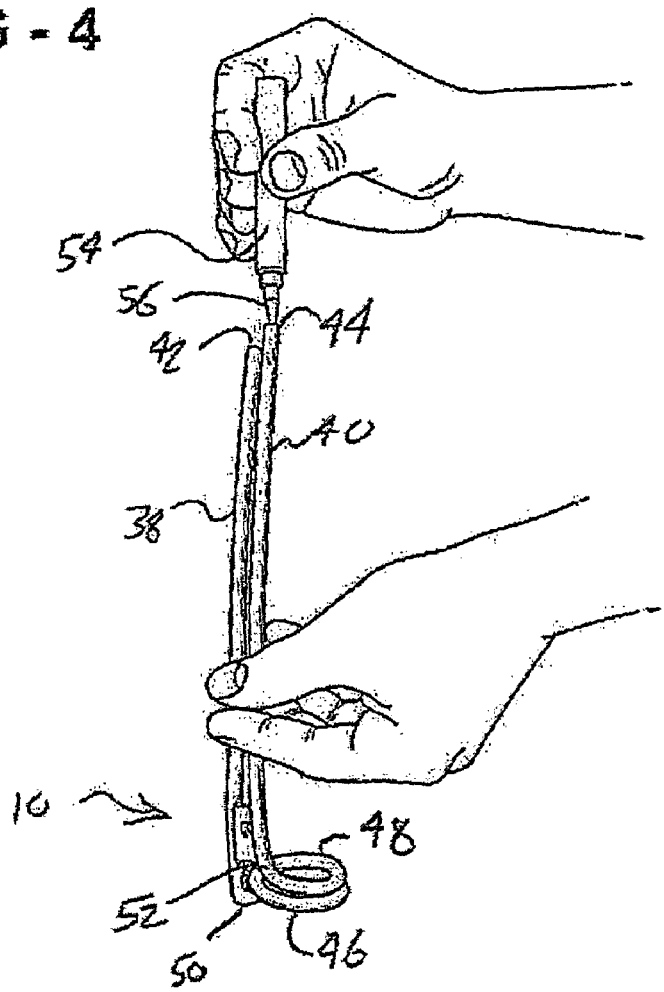
FIG. 4 illustrates in perspective the manner in which the siphon tube is charged with a (dye colored) fluid in order to initiate the vacuum trickle flow from the toilet tank to the toilet bowl.
Figure 5:
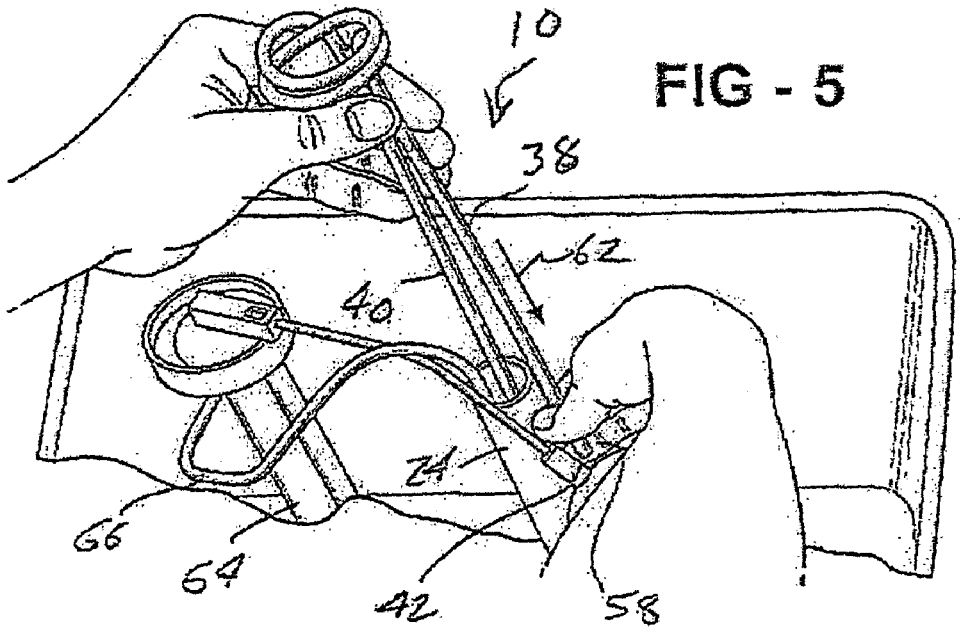
FIG. 5 is an environmental perspective illustration, similar to that previously shown in FIG. 2, and illustrating an alternate installation variant of the siphon tube according to the present invention.

Upon prefilling the siphon tube 10 with a volume of fluid, a description for which is illustrated in reference to FIG. 4, and such as which is further illustrated through the use of a filler bottle 54 with a nozzle 56 in FIG. 4. The first shorter end 42 is temporarily sealed, such as by an installer temporarily holding a finger 58 over the first end, as is illustrated in FIG. 5. The extending second length is then inserted into the conventional overflow tube 24 arrangement in the tank reservoir, at which time the first end is concurrently submerged into the tank reservoir, as is again shown in the cutaway illustration of FIG. 3.

In operation, a trickle flow of fluid is drawn from the fluid filled tank reservoir 22, by vacuum pressure as is indicated by directional arrow 60 in FIG. 3, into the first length 38, across the winding coils 46 and 48, and out the second length 40 into the bowl, again illustrated schematically at 28 in FIG. 3. In use, the trickle flow established throughout the toilet causes the ball cock and valve components to occasionally activate, thus drawing fluid from the supply line 12 into the tank reservoir 22, this occasional flow preventing freezing of the cold water inlet line resulting from wintertime conditions.

Figure 2:
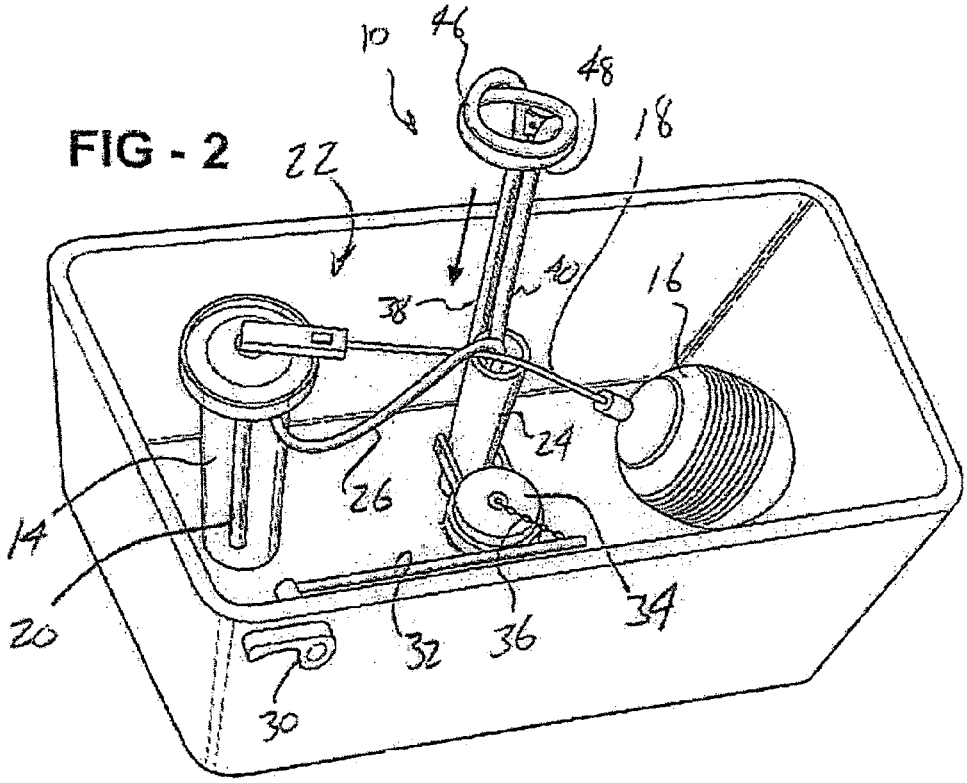
FIG. 2 is a perspective environmental view illustrating the siphon tube in inserting fashion within the water discharge tube associated with the toilet tank.

Referring again to FIG. 5, an alternate mounting arrangement of the siphon tube 10 within the tank reservoir 22 is illustrated, as compared to that shown in FIGS. 2 and 3. In particular, the angular configuration of the siphon tube 10 is such that the first shorter end 38, upon installation as referenced by arrow 62, extends in a rotated condition within the tank reservoir. As is further shown, the configuration of the inlet cylinder 64 with overflow line 66 leading to overflow tube 24 may differ in regards to that shown in FIG. 2, however without otherwise affecting the operational characteristics of the siphon tube 10.

A method for installing a siphon tube as substantially described above is also disclosed and includes the basic steps of inverting the siphon tube so that first and second length ends are arrayed in a generally upwardly extending direction, prefilling the siphon tube with a volume of fluid and temporarily sealing (such as again by applying the installer's finger) over the first length end. Additional steps include inserting the second extending length into the overflow tube vacuum drawing a trickle flow of fluid the tank reservoir, into the first length, across the winding coils, and out the second length into the bowl, the ball cock valve occasionally activating to draw fluid from the supply line into the tank reservoir. Yet additional steps include the injecting of the nozzle end 56 of the filler bottle 54 into a selected one of the first and second length ends, and the step of applying a dye colorant (such as which may be premixed into the charged fluid contained within the bottle 54), in order to visually confirm the continual and trickle flow of fluid through the siphon tube 10, and into the toilet bowl.

Figure 6:
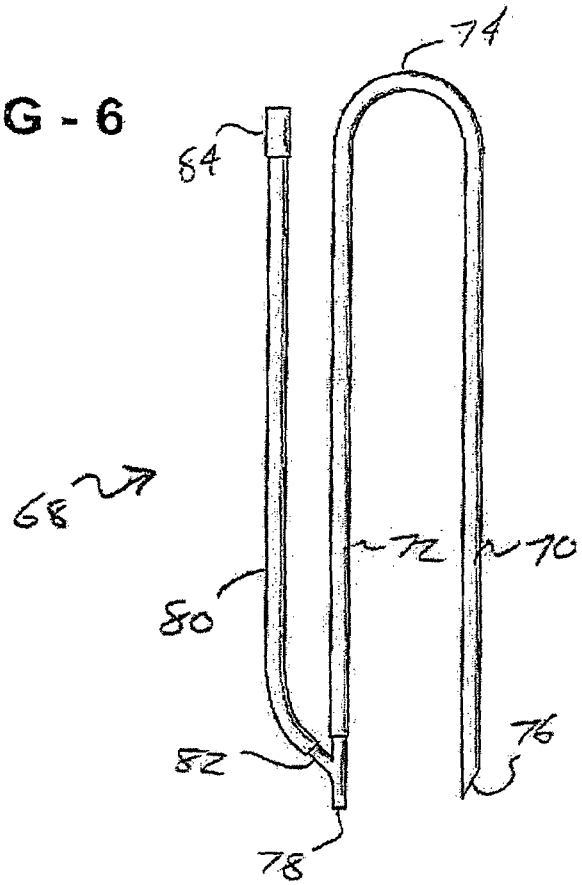
FIG. 6 is an illustration of a self-priming siphon tube according to a further preferred embodiment of the present invention.
Figure 7:
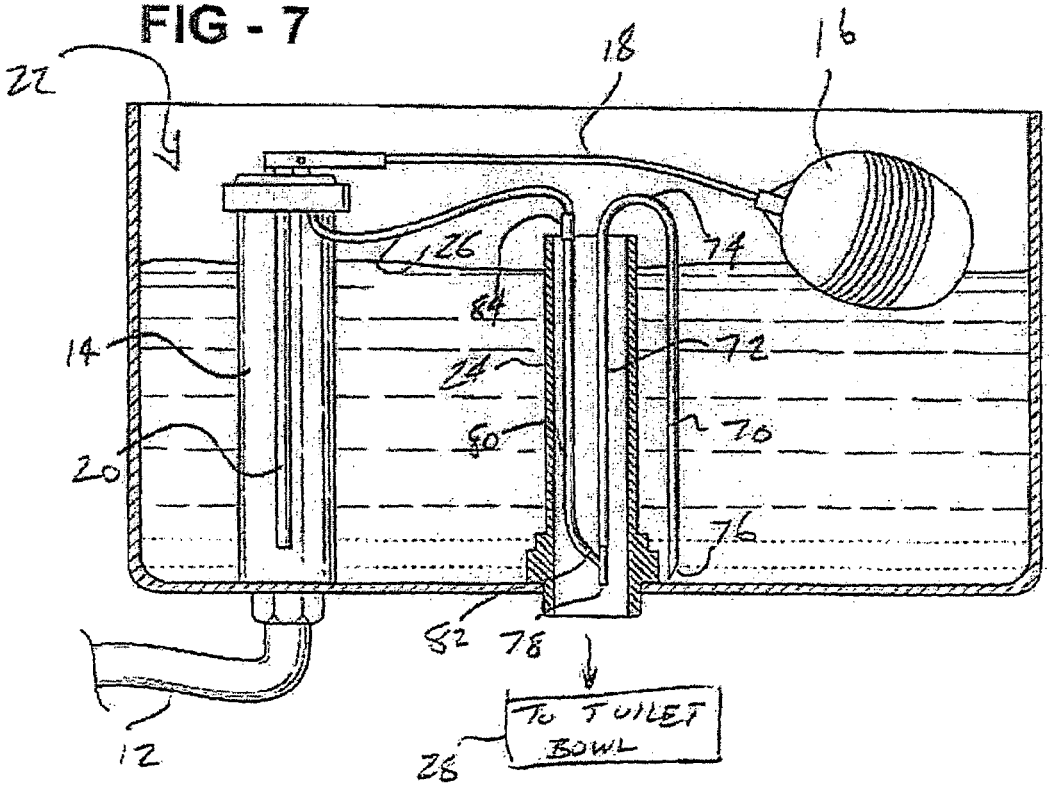
FIG. 7 is a cutaway environmental view, similar to that illustrated in FIG. 3, and further showing the self-priming siphon tube in installed fashion in the toilet tank overflow tube and which fluidly interconnects the water inlet feed, toilet tank reservoir and toilet bowl and provides for self-priming upon flushing the toilet.

Referring now to FIGS. 6 and 7, a further variant of a self-priming siphon tube is illustrated generally at 68 according to a second preferred embodiment of the present invention. The siphon tube 68 is, similar to the tube 10 in the first preferred embodiment, constructed of a durable and plastic material which includes an elongated and interiorly hollowed body having a first extending length 70 and a second fluidly interconnecting and parallel extending length 72 separated from the first length by an upper arcuate or "U" shaped interconnecting portion. As with the siphon tube 10, it is also desirable that either or both of the first and second associated length ends, such as is shown in FIG. 6 at 76 for first length 70, is angled in order to prevent the interruption of vacuum flow, resulting from seating/sealing of the associated length end and against such as a bottom surface of the tank reservoir.

Additional features of the self-priming siphon tube 68 include the second extending length 72 terminating in a "Y" fitting, and such as which further includes a downwardly extending open end 78. A third upwardly extending and substantially parallel length 80 extends from the second length 72, proximate the lower end 78, via an arcuate connection 82. The third length 80 terminates in a coupling end 84, the purpose for which will now be described in further reference to FIG. 7.

In operation, the "Y" fitting portion of the tube is inserted approximately halfway down into the overflow tube 24 and the overflow line 26 is connected to the coupling end 84 of the third upwardly extending length 80. To assist in verifying correct operation of the siphon tube, a color tablet (not shown) is pre-placed into the overflow tube 26.

At this point, the "Y" fitting portion is inserted substantially the entire internal length of the overflow tube 24, and in such a fashion as to prevent the self-siphoning tube portion (i.e., the first running length 70) from contacting the float ball cock 16. Upon flushing of the toilet, the siphon tube 68 will begin to siphon itself, such as by fluid from within the tank being drawn into the first length 70, about the "U" shaped portion 74 and down into the overflow tube via the second interconnecting length 72.

As water begins to siphon out of the tank and into the bowl, the volume of water colored by the tablet inserted into the overflow tube will begin to show up in the bowl. This is indicative of the siphon tube correctly operating while maintaining the correct water level. As with the previous embodiment, and while in use, the trickle flow established throughout the toilet causes the ball cock and valve components to occasionally activate, thus drawing fluid from the supply line 12 into the tank reservoir 22, this occasional flow preventing freezing of the cold water inlet line resulting from wintertime conditions.

Having described my invention, other and additional embodiments will become apparent to those skilled in the art to which it pertains, without deviating from the scope of the appended claims.

I claim:

1. A self-priming siphon tube for maintaining a trickle flow of fluid through a tank reservoir and bowl of a toilet, a water supply line being in fluid communication with the tank by virtue of a ball cock valve, the tank reservoir fluidly interconnecting with the bowl by an overflow tube, said siphon tube comprising:

an elongated and interiorly hollowed body including first and second fluidly interconnecting and parallel extending lengths separated by an arcuate shaped portion; and a third extending length of conduit fluidly interconnecting with a location associated with said second extending length opposite said arcuate shaped portion;

an end of said siphon tube corresponding to said interconnection between said second and third lengths being inserted into the overflow tube corresponding with the overflow line fluidly connecting to an extending end of said third length, a continuous trickle flow of fluid being drawn from the tank reservoir by said siphon tube and discharged into the bowl.

2. The siphon tube as described in claim 1, said arcuate shaped portion further comprising a "U" shaped portion interconnecting said first and second lengths of conduit.

3. The siphon tube as described in claim 1, further comprising a substantially "Y" shaped portion interconnecting said second and third lengths of conduit.

4. The siphon tube as described in claim 1, further comprising an extending end of said first length of conduit being angled.

5. The siphon tube as described in claim 1, said siphon tube exhibiting a specified shape and size and being constructed of a plastic material.

6. A self-priming siphon tube for maintaining a trickle flow of fluid through a tank reservoir and bowl of a toilet, comprising:

a plurality of first, second and third fluidly interconnected and substantially parallel lengths of conduit; and an open end of said tube corresponding to an interconnection between said second and third lengths of conduit being inserted into an overflow tube associated with the tank reservoir, a further open end of said tube being submerged within the reservoir;

a trickle flow of fluid to be drawn from the tank reservoir, by vacuum pressure, into said siphon tube and discharged into the bowl.

7. The siphon tube as described in claim 6, an overflow line extending from an inlet cylinder associated with the toilet reservoir, further comprising an upwardly extending end of said third length of conduit securing to the overflow line.

8. The siphon tube as described in claim 6, further comprising a substantially "Y" shaped portion interconnecting said second and third lengths of conduit.

9. The siphon tube as described in claim 6, further comprising an end associated with said first conduit length being angled.

10. The siphon tube as described in claim 6, said siphon tube exhibiting a specified shape and size and being constructed of a plastic material.

11. A method for installing and priming a siphon tube for maintaining a trickle flow of fluid through a tank reservoir and bowl of a toilet, a water supply line being in fluid communication with the tank by virtue of a ball cock valve supported upon an inlet cylinder and an overflow line extending from the cylinder into the reservoir, the tank reservoir fluidly interconnecting with the bowl by an overflow tube secured to a base of the reservoir, said method of installation comprising the steps of:

providing an elongated and interiorly hollowed body having first, second and third fluidly interconnecting and parallel extending lengths;

inserting an interconnecting end established between said second and third extending lengths into the overflow tube and concurrently submerging a further end associated with said first extending length into the tank reservoir;

securing a further extending end associated with said third extending length to an end of the overflow line;

flushing the toilet; and vacuum drawing a trickle flow of fluid the tank reservoir, into said first length, and out said interconnecting end inserted into the overflow tube, the ball cock valve occasionally activating to draw fluid from the supply line into the tank reservoir.

12. The method as described in claim 11, further comprising the step of applying a dye colorant to a volume of fluid contained within the overflow tube.

* * * * *